United States Patent [19]

Hunts

[11] Patent Number: 4,679,322

[45] Date of Patent: Jul. 14, 1987

[54] HAIR CLIPPER

[76] Inventor: Rick E. Hunts, 885 Barsby, Vista, Calif. 92083

[21] Appl. No.: 882,825

[22] Filed: Jul. 7, 1986

[51] Int. Cl.[4] ..... B26B 19/44

[52] U.S. Cl. ..... 30/133; 30/220

[58] Field of Search ..... 30/133, 200, 216–220

[56] References Cited

U.S. PATENT DOCUMENTS

| | | | |
|---|---|---|---|
| 1,331,218 | 2/1920 | Severson | 30/133 |
| 2,630,628 | 3/1953 | Hall | 30/220 X |
| 3,100,342 | 8/1963 | Konig | 30/200 |

*Primary Examiner*—Douglas D. Watts

*Attorney, Agent, or Firm*—Charmasson & Holz

[57] ABSTRACT

A precision hair clipper for cutting the hair of a subject to a uniform length which comprises a housing defining a flow chamber attachable to a vacuum hose. At the inlet of the housing a pair of reciprocating blades are configured to maintain a constant and equal flow of air through the chamber. Each of the blades is symmetrical to the other and features a row of parallel, sharp-edged slots. The row of slots of each blade is slanted in opposite direction to the row of the other blade so that their lateral oscillation results in a plurality of criss-crossing shearing edge action. The blades are driven by a pair of oppositely phased eccentric cams engaging openings in the blades. Selectable spacing of the clipper in relation to the subject's scalp is provided by a series of snap-on adjustable spacers.

12 Claims, 7 Drawing Figures

HAIR CLIPPER

BACKGROUND OF THE INVENTION

This invention relates to haircutting tools and more particularly to motor-driven clippers which are connected to suction devices such as vacuum cleaners; wherein the airflow is used to pull the air to a convenient cutting position and to efficiently evacuate the clippings.

Various devices of this type have been proposed in the past. In a first group best exemplified by U.S. Pat. Nos. 1,238,461 Bourdelat, 2,980,994 Stachon and 3,138,870 Stachon, a rotating blade is mounted across the vaccum flow channel. A second group of such clippers as disclosed in U.S. Pat. Nos. 1,730,889 Hoberecht, 3,979,825 Baumann, 4,077,122 Rollor, Jr. et al., and 4,188,720 Korf uses oscillating blades, the latter with the added improvement of a translating movement of the oscillating blades across the airflow channel. The avowed object of such an improvement was to cause a straight alignment of the air under the vacuum pull and an even cutting of the hair to a constant length. The Korf approach requires a complex mechanism and suffers from the fact that large quantities of hair drawn into the vacuum channel, when attacked by the advancing blade may bunch up and and bend away from the blade. This may result in a very uneven clipping of some of the hair. The translating movement of the blade carriage takes time and consumes a great deal of energy.

In some of the earlier devices the rotary blades interfered with the regular flow of air through the housing, causing pulsations and turbulences which interfered with the proper alignment of the hair.

In his quest for a solution to the problem presented by the prior types of clippers, the applicant began experimenting with some concept akin to some of the older and simple designs such as disclosed in Hoberecht. He eventually devised a new blade configuration which palliates all the defects of the prior art.

SUMMARY OF THE INVENTION

The present invention is characterized by the use of an improved set of oscillating blades which span the entire cross-section of the flow channel with a series of criss-crossing shearing edges without interfering with the regular flow of air. Principal and secondary objects of the invention are:

to create a multitude of fast-acting cutting elements;

to prevent the air from gathering in bunches and from bending away from the blade;

to simplify the driving mechanism, minimize the instrument maintenance needs and extend its useful life;

to eliminate vibrations, noise and reduce the weight of the device; and to allow adjustable spacing between the line of cut and the scalp of the subject for a more stylish clipping of the hair.

These and other objects are achieved by means of a pair of reciprocating blades each having a row of parallel slots which are slanted in relation to the oscillating movement of the blades and in opposite direction from one blade to another. This creates a criss-crossing movement of the slot and of their cutting edges. The blades are oscillated by two eccentric cams engaging apertures in the blades and driven by an electric motor.

Spacers of various lengths and configurations are provided for attachment to the mouth of the clippers.

DESCRIPTION OF THE PREFERRED EMBODIMENT

Figures 1, 2, 3, 4, 5, 6, 7:
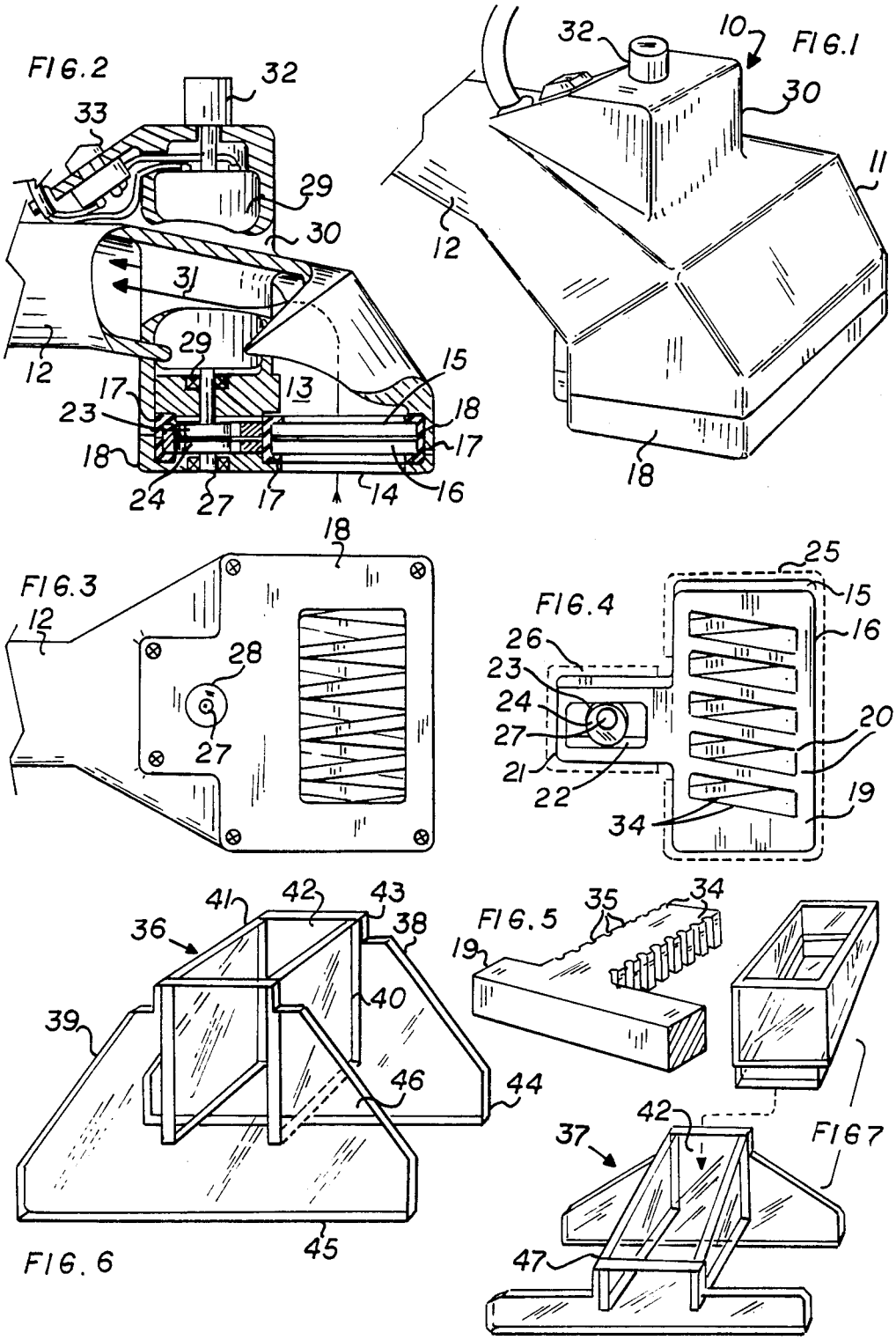
FIG. 1 is a perspective view of the clipper.
FIG. 2 is a side elevational view of the clipper with a cutaway in the housing to expose the drive mechanism.
FIG. 3 is a bottom plan view of the clipper.
FIG. 4 is a bottom plan view of the blades.
FIG. 5 is a enlarged detail view of one edge of the blades.
FIG. 6 is a perspective view of a first style of spacer.
FIG. 7 is a perspective view of a second style of spacer with detachable extension.

Referring now to the drawing, there is shown a motorized hair clipper 10 housed in an enclosure 11 which extends rearwardly into a tubular handle 12 for attachment to a source of vacuum such as a vacuum cleaner or the like. The enclosure 11 forms a flow chamber 13 with air being drawn through the mouth 14 in the base of the housing 11. The mouth 14 defines a rectangular inlet which is spanned by a pair of oscillating plates 15, 16 acting as cutting blades.

The plates which are more specifically illustrated in FIG. 4 are slidingly mounted against each other. They are supported along their peripheries by a frame bearing 17 retained in a recess formed at the enclosure 11 and in the bottom cover 18. Each plate 15, 16 comprises a rectangular blade portion 19 with a plurality of cutting slots 20, and a rear projection 21 with a central aperture 22 forming a strap around an eccentric cam 23, 24. The frame bearing 17, the outline of which is delineated in broken lines in FIG. 4, is in two sections 25, 26. The first section 25 holds the blade portions 19, and the second section holds the strap 21. The frame bearing 17 confines the plates 15, 16 to oscillations along the longitudinal axis of the blade portion 19. In FIG. 4, the plates are shown at their maximum execursion within the frame bearing 17.

The cams 23, 24 are installed on a shaft 27 which is mounted orthogonally to the planes of the plates 15, 16 and is supported by bearing 28 in the bottom cover 18 and by bearing 29 in the body of the enclosure 11. The cams 23, 24 are mounted in opposite phase so that the top plate 15 reaches its maximum excursion toward one side when the bottom plate 16 reaches its maximum excursion toward the opposite side. The balanced configuration and movement of the plates assures a vibration-free operation of the clipper. The shaft 27 is driven by an electrical motor 29 housed in a tubular structure 30 which extend through the flow chamber 13. The air flow through the inlet mouth 14 across the slots 20 of the plates, through the flow chamber 13, past the motor structure 30 and into the vacuum outlet 12 is indicated by split arrow 31 in FIG. 2. The shaft 27 extends upwardly through the motor 29 to a knob 32 on top of the enclosure 11. This knob 32 can be used to operate the plates manually for cleaning purposes. The knob could also be removed, and the tip of the shaft connected to another rotating drive, in lieu of the motor 29. A switch 33 in the top of the enclosure 11 control the energizing of the motor 29. The blade portion 19 of each plate is characterized by a row of parallel slots 20 which are oriented obliquely from the direction of oscillation of the plates. The two plates 15, 16 are made identical to each other. However, they are stacked back-to-back so that the slots 20 of one plate are slanted in the opposite direction in relation to the slots of the other plate.

During the oscillating movement of the plates the edges 34 of two superimposed slots criss-cross each other to define a series of shearing elements. The slots are spaced and proportioned so that the total aperture of the combined slots during the entire oscillation of the plates remain essentially constant. This prevents pulsations and disturbances of the air flow through the device which could affect the proper alignment of the hair. Any hair which is drawn into one of the slots is neatly clipped by the scissor-like action of the edges 34. The cutting action can be improved by serrating the edges 34 of the slots with hair-line indentation 35 as illustrated in FIG. 5. The wall of the slots need not be slanted in relation to the plane of the plates to obtain a positive shearing action.

The plates are preferably made from tempered steel. A thickness of at least 1 millimeter is recommended in order to maintain a certain inertia and store sufficient kinetic energy to provide a smooth cutting action.

A variety of spacers 36, 37 may be used to keep the mouth 14 of the clipper 10 at a constant but adjustable distance from the scalp of the subject in order to clip his hair to a predetermined length. The first spacer 36, is made from four plates of plexiglass 38, 39, 40, 41 which define a channel 42 whose upper rim 43 can be snapped into the mouth 14 of the clipper 10. Two of the plates 38, 39 forming opposite walls of the channel 42 extend downwardly further than the two other plates 40, 41 to form a convenient sliding pair of feet 44, 45 which slide over the subject's scalp, leaving a gap 46 below the two other plates 40, 41 for hair to enter the channel 42 toward the mouth 14 of the clipper 10.

In a second embodiment 37 of the spacer, the upper rim 47 defines a plane which is oriented obliquely in relation to the longitudinal axis of the channel 42 formed by the walls of the spacer 37. This type of spacer would be used to taper hair around the ears and neckline. An extension 48 can be inserted between the spacer 37 and the mouth 14 of the clipper to increase the cutting distance or to change to tapering angle depending upon the orientation of the extension 48 in relation to the spacer 37. When inserted as shown in FIG. 7, the incline of the base 49 of the extension would compensate for the incline defined by the upper rim 50 of the extension 37. If the extension 37 was turned 180 degrees the clipping angle would be increased.

While the preferred embodiment of the invention has been described, modifications could be made to it, and other embodiments could be devised without departing from the spirit of the invention and the scope of the appended claims.

What is claimed is:

1. A precision hair clipper for cutting the hair of a subject to a uniform length at a selectable spacing from the subject's scalp which comprises:

a housing defining a flow chamber having an inlet and an outlet connectable to a vacuum source;

a pair of balanced plates, each having a plurality of openings;

said plates being slidingly mounted against each other across the inlet;

means for oscillating said plates in opposite phases within their own planes;

wherein the edges of the openings of one plate cooperate with the edges of the opening in the other plate to shear hair drawn into the housing by said vacuum source; and wherein said openings are shaped and positioned in relation to one another to maintain a generally constant aperture area therethrough, throughout a complete oscillating cycle of the plates; and wherein said means for oscillating comprises:

means for maintaining the plate in a linear direction throughout said oscillating cycle; and said openings in each one of said plates comprise a plurality of parallel and symmetrical slots oriented obliquely in relation to said linear direction of the plates.

2. The hair clipper claimed in claim 1, wherein the slots of one plate obliquely criss-cross the slots of the other plate.

3. The hair clipper claimed in claim 2, wherein said means for oscillating comprises:

a rotating shaft orthogonal to the planes of the plates;

a pair of oppositely phased eccentric cams mounted on said shafts;

each one of said cams acting on one of said plates; and means for rotating said shaft.

4. The hair clipper claimed in claim 3, wherein said means for rotating comprise a motor.

5. The hair clipper claimed in claim 3, wherein each of said plates has a cut-out forming a strap about one of said cams.

6. The hair clipper claimed in claim 2, wherein the edges of said slots are serrated.

7. The hair clipper claimed in claim 6, wherein said plates are made of steel and have a uniform thickness about said opening of at least 1 millimeter.

8. The hair clipper claimed in claim 2 which further comprises means attachable to said inlet for maintaining a uniform spacing between said inlet and the subject's scalp.

9. The hair clipper claimed in claim 8, wherein said means for maintaining comprises a channel having a upper rim engaging said inlet and two lower projections, each extending from the lower edge of of the channel.

10. The hair clipper claimed in claim 8, wherein said means for maintaining comprises a four-walled channel having at one end a rim engaging said inlet and a pair of projections at the other end extending from the edges of two opposite walls of the channel.

11. The hair clipper claimed in claim 10, wherein the edges of said rim define a plan which is slanted in relation to the longitudinal axis of the channel.

12. The hair clipper claimed in claim 10, wherein said channel comprises at least one detachable extension.

* * * * *